US008299699B2

(12) United States Patent
Li et al.

(10) Patent No.: US 8,299,699 B2
(45) Date of Patent: Oct. 30, 2012

(54) DOUBLE-SIDED LIGHT EMITTING FIELD EMISSION DEVICE AND METHOD OF MANUFACTURING THE SAME

(75) Inventors: Yuan-Yao Li, Chia-Yi (TW); Meng-Jey Youh, New Taipei (TW); Chun-Lung Tseng, Alian Shiang (TW); Hung-Chih Wu, New Taipei (TW); Wang-Hua Lin, Chia-Yi (TW); Yen-Ming Juan, Sanyi Township, Miaoli County (TW); Sheng-Cheng Chiu, Zhongpu Township, Chiayi County (TW)

(73) Assignee: National Chung Cheng University, Chia-Yi (TW)

( * ) Notice: Subject to any disclaimer, the term of this patent is extended or adjusted under 35 U.S.C. 154(b) by 0 days.

(21) Appl. No.: 13/209,892

(22) Filed: Aug. 15, 2011

(65) Prior Publication Data

US 2012/0248967 A1 Oct. 4, 2012

(30) Foreign Application Priority Data

Apr. 1, 2011 (TW) ..... 100111627 A

(51) Int. Cl.
*H01J 1/62* (2006.01)

(52) U.S. Cl. ..... 313/495; 313/309

(58) Field of Classification Search ..... 313/495, 313/496, 309, 310, 336, 351
See application file for complete search history.

(56) References Cited

U.S. PATENT DOCUMENTS

2007/0222363 A1* 9/2007 Qian et al. ..... 313/496

* cited by examiner

*Primary Examiner* — Vip Patel
(74) *Attorney, Agent, or Firm* — Muncy, Geissler, Olds & Lowe, PLLC

(57) ABSTRACT

A double-sided light-emitting field emission device and method of manufacturing same, said device comprising at least two transparent conductive layers, mixed field emission layers, and transparent package device. Wherein, the mixed field emission layer of field emission source and phosphor are utilized directly to serve as anode and cathode alternatively, such that on applying an AC power supply, roles of anode and cathode are changed alternatively along with frequency, hereby forming double-sided light-emitting structure. Therefore, the applications of said double-sided light-emitting field emission device are pretty wide, and having advantages of protecting field emission source, activating field emission source, reducing field emission arcing effect, having conductive phosphor, and raising illumination.

19 Claims, 4 Drawing Sheets

(a)

(b)

DOUBLE-SIDED LIGHT EMITTING FIELD EMISSION DEVICE AND METHOD OF MANUFACTURING THE SAME

BACKGROUND OF THE INVENTION

1. Field of the Invention

The present invention relates to a field emission device, and in particular to a double-sided light-emitting field emission device and method of manufacturing the same.

2. The Prior Arts

The Field Emission Display Technology incorporates and makes use of the technology of carbon nanotube, so that it is able to achieve great breakthrough and developments in various applications. In addition, due to its spontaneous light-emitting characteristics, the field emission device can not only be utilized as field emission display, but it can also be widely used as light-emitting device in backlight module or illumination light.

In general, the basic structure of field emission device is composed of a phosphor plate serving as an anode, and a carbon nanotube serving as a cathode. As shown in FIG. 1, the field emission device includes two glass substrates, an upper substrate 12 and a lower substrate 10, and a spacer 14 is disposed in-between as a support, so that the space between substrates 10 and 12 is in a vacuum state. The upper substrate is the so-called anode plate, that is provided with an electrode 16 and a layer of phosphor 18 and can be excited by electrons to emit light; while the lower substrate is a cathode plate, composed of an electrode 20 and a field emission array (FEA) 22, that can emit electrons by means of field emission principle. Therefore, the operation principle of the field emission device is that the cathode plate can emit electrons by means of the field emission principle, and that are accelerated by the electrical field to impact on and agitate the phosphor layer on the anode plate to emit lights.

Presently, the field emission device can be classified into a two-electrode type or a three-electrode type depending on the electrode structure, while for its driving and operation, Direct Current (DC) power supply is utilized. However, regardless of the type of electrodes, their common characteristics are that, they are all single-sided light emitting field emission light source, and thus having limited applications. Moreover, since presently, the field emission device is driven by DC voltage, charges tend to accumulate on the electrode to produce arcing effect; or the service life of the carbon nanotube is reduced considerably due to long period impact of electrons on the carbon nanotube.

Therefore, presently, the design and performance of the field emission device of the prior art is not quite satisfactory, and it has much room for improvements.

SUMMARY OF THE INVENTION

In view of the problems and shortcomings of the prior art, the present invention provides a double-sided light-emitting field emission device, that can not only solve the problem of the prior art, but it can also provide various applications.

A one objective of the present invention is to provide a double-sided light-emitting field emission device and method of manufacturing the same, which combines phosphor and field emission source to form a two-electrode structure, without the need to differentiate them into anode or cathode, then AC voltage driving is used in achieving double-sided light emitting for raising the overall illumination.

Another objective of the present invention is to provide a double-sided light-emitting field emission device and method of manufacturing the same, such that the driving voltage required for the double-sided light-emitting field emission device thus produced is an AC voltage, so the field emission sources can be alternated depending on frequency rather than conducting continuous emission, hereby protecting the carbon nanotube field emission source, and prolonging its service life.

A yet another objective of the present invention is to provide a double-sided light-emitting field emission device and method of manufacturing the same, which is able to activate the carbon nanotube field emission source. That is because when the roles of anode and cathode are exchanged, the electrons emitted will impact on the phosphor to make it emit light, meanwhile they may also impact on the carbon nanotube to produce effect similar to electron bombardment, thus achieving activation of the carbon nanotube.

A further objective of the present invention is to provide a double-sided light-emitting field emission device and method of manufacturing the same, wherein, since AC voltage is used to drive the Device, charges are not liable to be accumulated on the electrodes, so it does not tend to produce arcing effect as compared with DC voltage, hereby reducing field emission arcing effect.

A still another objective of the present invention is to provide a double-sided light-emitting field emission device and method of manufacturing the same, wherein, carbon nanotube and phosphor are mixed into a paste and is applied onto a substrate, so that carbon nanotube is attached onto the phosphor to make the phosphor electrically conductive.

In order to achieve the above mentioned objective, the present invention provides a double-sided light-emitting field emission device, comprising: at least two transparent conductive layers spaced apart, at least two mixed field emission layer provided respectively on the inner surface opposite to each of the transparent conductive layers, with each mixed field emission layer including at least a mixture of field emission source and phosphor; and a transparent package device wrapped around outside the transparent conductive layer to seal tightly the transparent conductive layer and mixed field emission layer.

In addition, the mixed field emission layer mentioned above further includes an additive obtained through mixing the field emission source and phosphor. The present invention further includes an AC power supply, connected to the two transparent conductive layers to supply AC power, so that the two mixed field emission layers serve as cathode and anode in rotation, in achieving light emitting alternatively.

The present invention further includes a light-emitting field emission device manufacturing method, including the following steps: firstly, mixing a field emission source, an additive, phosphor, and an organic vehicle evenly into a paste; next, applying the paste onto at least two transparent substrates in patterns, to serve as mixed field emission layers, and transparent conductive layers are already formed on the transparent substrates; then, performing sinter for each of the transparent substrates to remove the organic vehicle; and finally, disposing the two transparent substrates spaced apart, and sealing tightly the two transparent substrates, so that the mixed field emission layer is located in the tightly sealed space.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from this detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

The present invention provides an innovative double-sided light-emitting field emission device and method of manufacturing the same, wherein, phosphor and field emission source are mixed at certain ratio to produce field emission devices of cathode/anode substrates. Due to the alternating nature of the positive and negative polarities of AC power source, the substrates of the field emission device may play the role of cathode or anode alternatively to form a two-electrode structure without having to distinguish them being anode or cathode. Therefore, it can emit lights alternatively by means of AC voltage driving in achieving double-sided light emitting.

Figure 1:
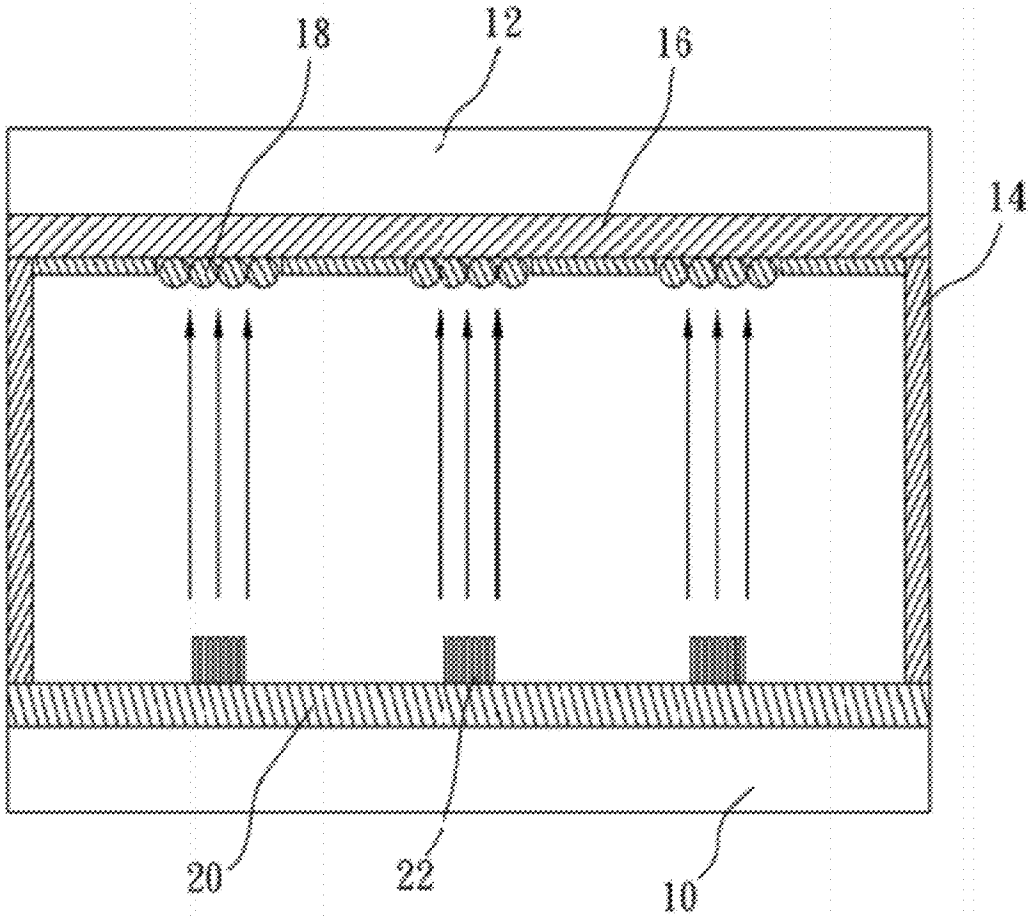
Fig. 1 (prior art)
FIG. 1 is a schematic diagram of a field emission device according to the prior art.
Figure 2:
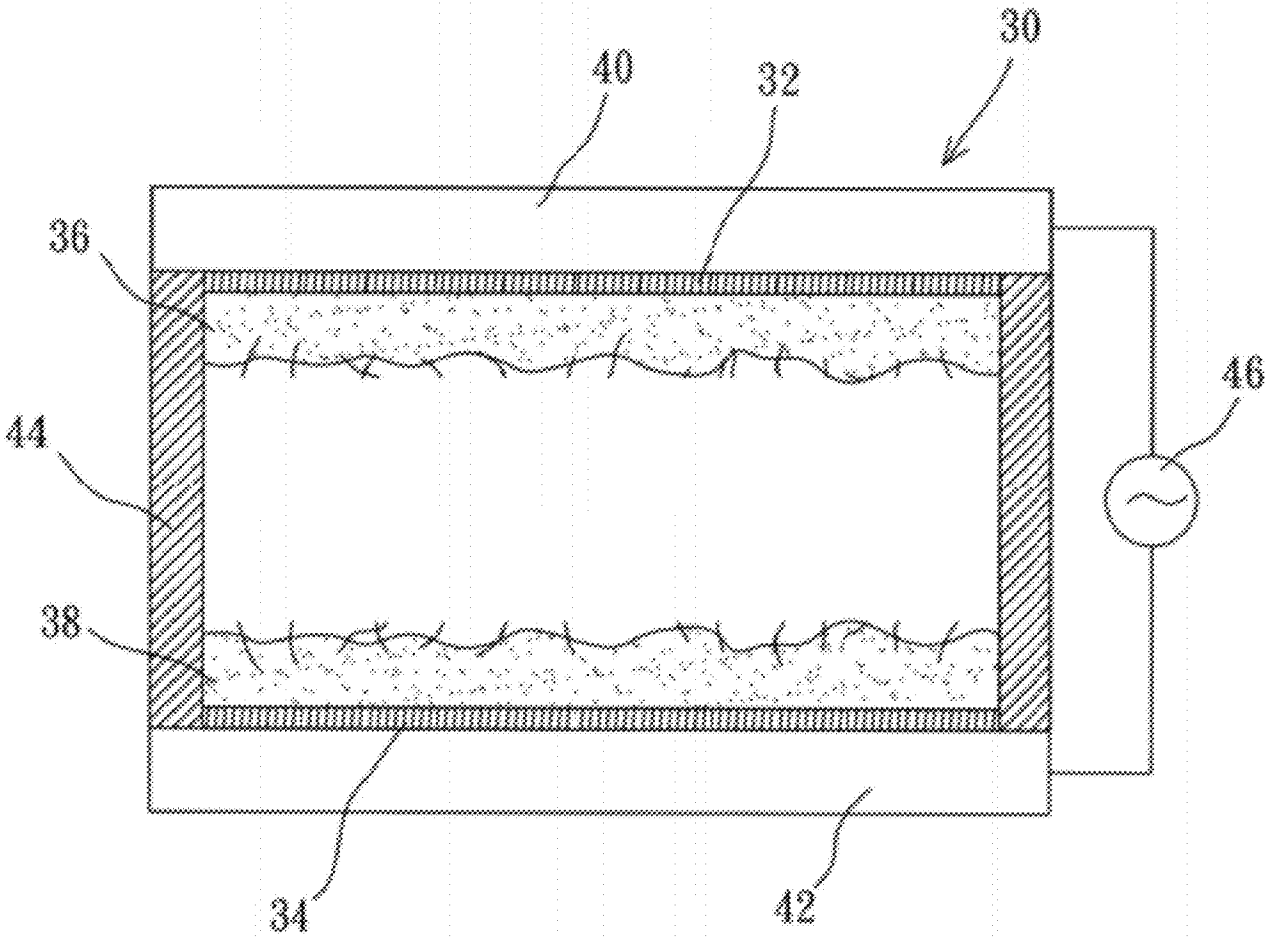
FIG. 2 is a schematic diagram of the double-sided light-emitting field emission device according to the present invention.

Refer to FIG. 2 for a schematic diagram of the double-sided light-emitting field emission device according to the present invention. As shown in FIG. 2, a double-sided light-emitting field emission device 30 includes at least two transparent conductive layers 32 and 34 spaced apart from each other, and mixed field emission layers 36 and 38 are provided respectively on the inner surfaces opposite to each of the two transparent conductive layers 32 and 34; moreover, a transparent package device is wrapped around outside the transparent conductive layers 32 and 34, to seal tightly the transparent conductive layers 32 and 34, and the mixed field emission layers 36 and 38. To be more specific, the transparent package device further includes at least two transparent substrates 40 and 42, such as glass substrates, disposed respectively on the outer surfaces of the transparent conductive layers 32 and 34, so that the transparent conductive layers 32 and 34 are disposed apart on the inner surface opposite to the two transparent substrates 40 and 42. At least a spacer 44 is placed around the perimeter between the two transparent substrates 40 and 42, so as to seal tightly the transparent conductive layers 32 and 34, and mixed field emission layers 36 and 38, hereby making it in a vacuum state.

In the descriptions above, each of the mixed field emission layers 36 and 38 is composed mainly of a mixture of field emission source and phosphor, in addition, additives can be added to be mixed fully with field emission source and phosphor, such that the percentage by weight (wt %) of the compositions of the mixed field emission layers are as follows: field emission source 0.1~10 wt %, phosphor 50~90 wt %, and additive 0~40 wt %. The mixed field emission source can be chosen from a group consisting of: carbon nanotube, carbon nanofiber, graphite film, silicon carbide, diamond film, silicon oxide, and metal oxide. Wherein, the metal oxide can be selected from a group consisting of: $Fe_2O_3$, ZnO, $MoO_3$, $SnO_2$, $WO_3$, and $TiO_2$, etc. The major function of the field emission source is to emit electrons through the field emission principle; and the phosphor is the phosphor powder that can emit red, green, blue, white light, or any of their combinations. Moreover, the additive can be selected from a group consisting of: Sn, Ni, Cu, Al, glass powder, and $SiO_2$, etc.

In driving the double-sided light-emitting field emission device 30, an AC power supply 46 connected electrically to the two transparent conductive layers 32 and 34 are utilized to provide AC power required, so as to make the two mixed field emission layers 36 and 38 to emit lights alternatively, and the duty cycle of the AC power supply can be 10~90%. Namely, when AC power supply 46 starts supplying AC power to the double-sided light-emitting field emission device 30, in case that the transparent conductive layer 32 and the mixed field emission layer 36 are utilized as anode, then the transparent conductive layer 34 and the mixed field emission layer 38 are utilized as cathode. At this time, the electrons emitted from the field emission source of the mixed field emission layer 38 are attracted by the electrical field and leave the surface of cathode, and they are accelerated to and impact on the phosphor in the mixed field emission layer 36 serving as anode, thus the phosphor is agitated into emit visible lights; when the positive and negative polarities of the AC power supply are exchanged, the transparent conductive layer 32 and the mixed field emission layer 36 are turned into cathode, while the transparent conductive layer 34 and the mixed field emission layer 38 are turned into anode, so that the electrons emitted by the field emission source in the mixed field emission layer 36 are accelerated to and impact on the phosphor in the mixed field emission layer 38 serving as anode, thus the phosphor is agitated into emit visible lights. As such, through this way of AC power supply driving, the field emission sources can be exchanged and alternated along with the frequency to stimulate the mixed field emission layers 36 and 38 to emit light alternatively in achieving double-side light emitting of the present invention.

Figure 3:
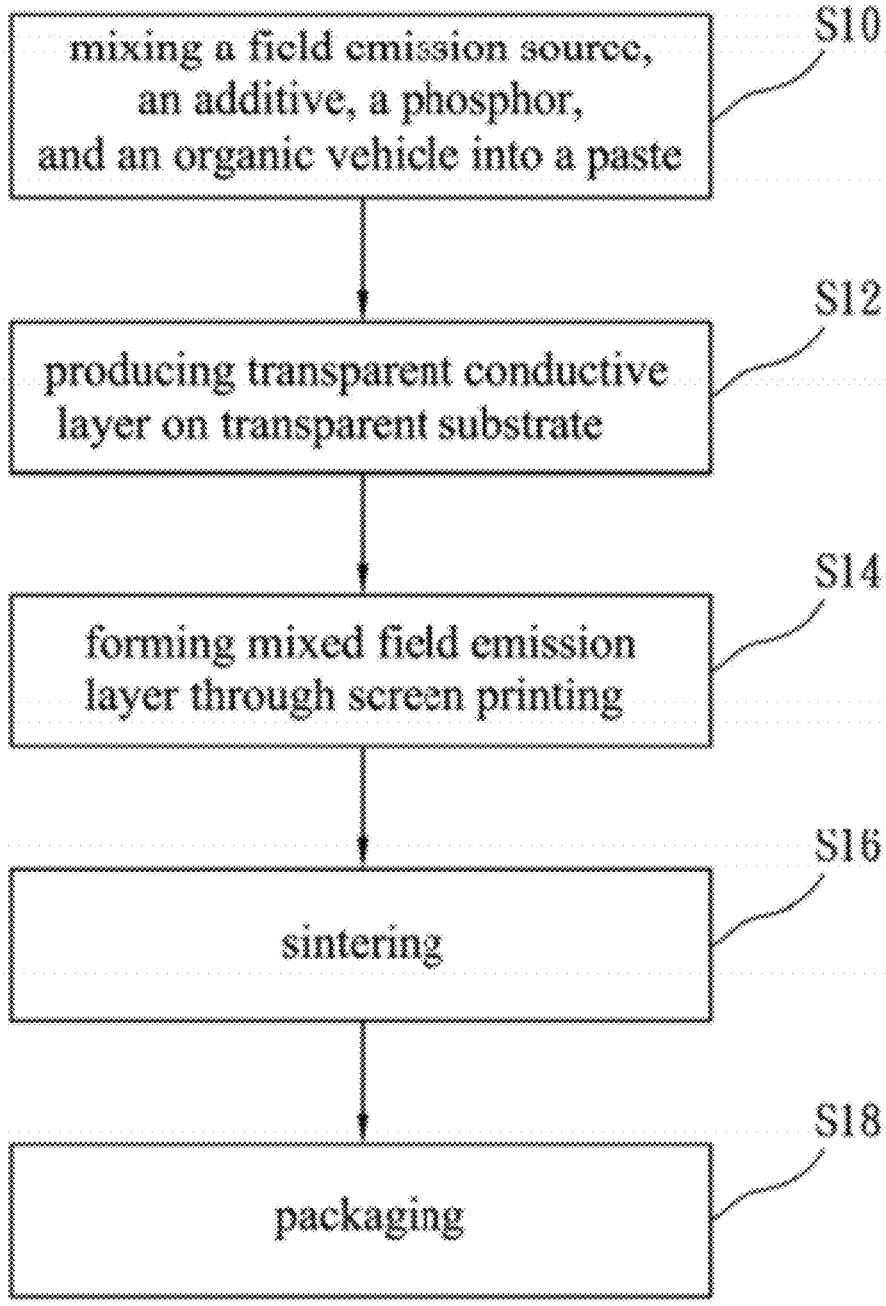
FIG. 3 is a flowchart of the steps of the method of manufacturing the double-sided light-emitting field emission device according to the present invention.

After describing the structure of double-sided light-emitting field emission device, in the following, the method of manufacturing double-sided light-emitting field emission device is described. FIG. 3 is a flowchart of the steps of the method of manufacturing the double-sided light-emitting field emission device according to the present invention. Refer to FIGS. 2 & 3 at the same time. As shown in FIG. 3, firstly, as shown in step S10, putting a field emission source, a additive, and a phosphor into a container sequentially at certain ratios mentioned above to mix them into a mixed field emission layer material. Next, putting the organic vehicle into the container, with the ratio of 30~50% mixed field emission layer material and 50~70% organic vehicle, wherein, the organic vehicle can be terpineol or ethyl cellulose, thus obtaining a paste after grinding and mixing them sufficiently even with three rollers. Then, as shown in step S12, providing transparent substrates 40 and 42, such as glass substrate, and applying transparent conductive layers 32 and 34, such as Indium-Tin-Oxide (ITO) onto the transparent substrates 40 and 42. Subsequently, designing structural patterns of cathode and anode on silk screens, and then as shown in step S14, placing the silk screen, and screen printing the patterned paste onto the surface of the transparent substrates 40 and 42 as the mixed field emission layers 36 and 38 by making use of a screen printing machine. Then, as shown in step S16, placing the transparent substrates into an oven or an atmosphere furnace to perform sinter for each of the transparent substrates based on the characteristics of the paste, in removing organic vehicle such as polymer, and solvent, hereby finishing the sinter operation. In the process mentioned above, the sinter temperature raising conditions are as follows: temperature raising speed 5~10° C./minute, reaction temperature 30~400° C. atmosphere is air, and reaction duration is 1 hour. Finally, as shown in step S18, performing packaging of the field emission device, disposing the two transparent substrates 40 and 42 spaced apart from each other, enclosing and tightly sealing a spacer 44 around the perimeter of the two transparent substrates 40 and 42, so as to seal tightly the transparent conductive layers 32 and 34 and the mixed field emission layers 36 and 38 on the inner surfaces opposite to the transparent substrates 40 and 42, hereby making them into a vacuum state; as such, achieving the structure of double-sided light-emitting field emission device 30 as shown in FIG. 2.

In the embodiment mentioned above, paste is formed on transparent substrate through screen printing. Moreover, patterned mixed field emission layer can be formed on transparent substrate by means of thin film lithographic process.

Figure 4:
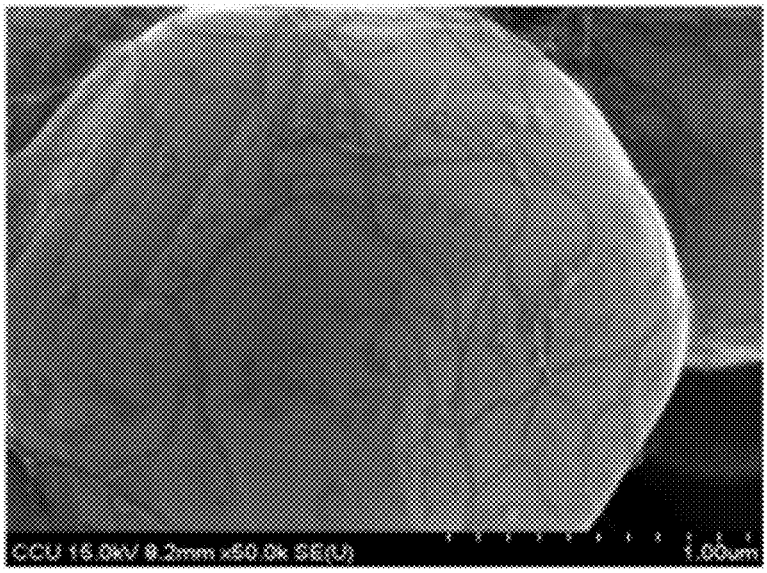
FIG. 4 is a diagram of sintered carbon nanotube and phosphor produced by a scanning electron microscope (SEM) according to the present invention.
Figure 4:
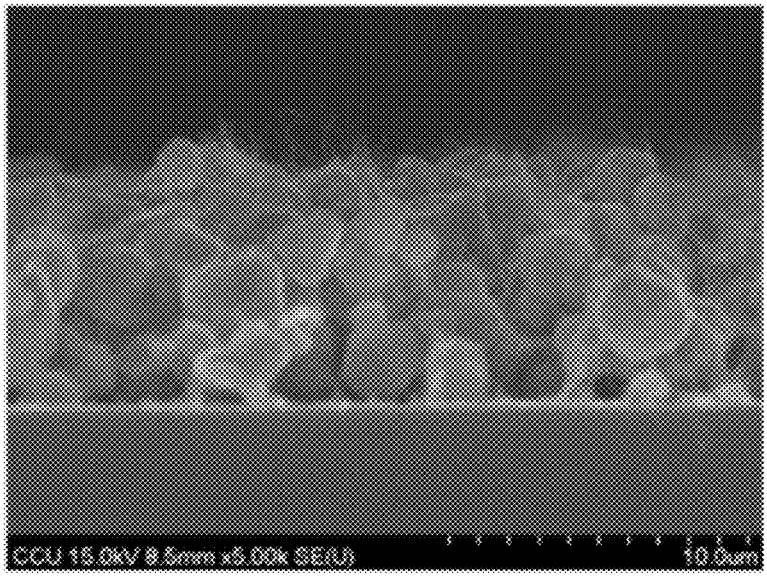

In the following, the carbon nanotube is taken as an example for explanation, and the diagram of sintered carbon nanotube and phosphor produced by a scanning electron microscope (SEM) is as shown in FIG. 4, wherein, FIG. 4(*a*) is a top view, and FIG. 4(*b*) is a cross section view. From this SEM diagram it is evident that, the carbon nanotubes serving as field emission source are distributed evenly in the phosphor.

In the present invention, an AC power supply is utilized, so that the roles of anode and cathode can be varied and exchanged depending on frequency in achieving double-sided light emitting, thus it is able to have enormous business applications in the sphere of backlight module and field emission displayer. Furthermore, the characteristics of the present invention can be summarized as follows:

(1) protecting the field emission source: such as protecting the carbon nanotube emission source, since AC voltage is used to drive the double-sided light-emitting field emission device thus produced, so the field emission sources can be alternated depending on frequency rather than conducting continuous emissions, hereby protecting the carbon nanotube and prolonging its service life;

(2) activating the field emission source: such as activating the carbon nanotube emission source, when the roles of anode and cathode are exchanged, the electrons emitted will impact on the phosphor to make it emit light, meanwhile they may also impact on the carbon nanotube to produce effect similar to electron bombardment, thus achieving activation of the carbon nanotube;

(3) reducing the field emission arcing effect: since AC voltage is used to drive the Device, charges are not liable to be accumulated on the electrodes, so it can prevent instantaneous arc discharge, and it is not liable to produce arcing effect as compared with DC voltage, hereby reducing field emission arcing effect;

(4) electrically conductive phosphor: in the present invention, carbon nanotube and phosphor are mixed into a paste to be applied onto substrate, such that the carbon nanotube will be attached onto the phosphor to make it conductive; and (5) raising the illumination: compared with DC voltage driving, the intensity of AC electrical field in the same space interval can be increased (0~20V/μm), hereby achieving greater light emitting illumination for double-sided light emitting than single-sided light emitting.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A double-sided light-emitting field emission device, comprising:

at least two transparent conductive layers, spaced apart to each other;

at least two mixed field emission layers, each including at least a mixture of field emission source and phosphor, and is located on an inner surface of said transparent conductive layer; and a transparent package device, wrapped around outside said transparent conductive layer, to seal tightly said transparent conductive layer and said mixed field emission layer.

2. The double-sided light-emitting field emission device as claimed in claim 1, wherein said transparent packaging device further includes at least two transparent substrates, located respectively on outer surface of said transparent conductive layers; and at least a spacer, surrounded around perimeter of said two transparent substrates, so as to seal tightly said transparent conductive layers and said mixed field emission layer.

3. The double-sided light-emitting field emission device as claimed in claim 1, further comprising: an AC power supply, connected to said two transparent conductive layers to provide AC power, so as to make said two mixed field emission layer emit lights alternatively.

4. The double-sided light-emitting field emission device as claimed in claim 1, wherein said field emission source is carbon nanotube, carbon nanofiber, graphite film, silicon carbide, diamond film, silicon oxide, or metal oxide.

5. The double-sided light-emitting field emission device as claimed in claim 4, wherein said metal oxide is $Fe_2O_3$, ZnO, $MoO_3$, $SnO_2$, $WO_3$, or $TiO_2$.

6. The double-sided light-emitting field emission device as claimed in claim 1, wherein said phosphor is a phosphor powder that emits red, green, blue, or white lights.

7. The double-sided light-emitting field emission device as claimed in claim 1, wherein said mixed field emission layer further includes an additive, that is mixed with said field emission source and said phosphor.

8. The double-sided light-emitting field emission device as claimed in claim 7, wherein said additive is Sn, Ni, Cu, Al, glass powder, or $SiO_2$.

9. The double-sided light-emitting field emission device as claimed in claim 7, wherein percentages by weight (wt %) of compositions of said mixed field emission layer are as follows: field emission source 0.1~10 wt %, phosphor 50~90 wt %, and additive 0~40 wt %.

10. A method of manufacturing double-sided light-emitting field emission device, comprising following steps:

mixing a field emission source, an additive, a phosphor, and an organic vehicle evenly into a paste;

forming patterned paste on at least two transparent substrates respectively, to serve as mixed field emission layers, and transparent conductive layers are already formed on said transparent substrates;

performing sinter for each of said transparent substrates; and disposing said two transparent substrates apart from each other and sealing them tightly.

11. The method of manufacturing double-sided light-emitting field emission device as claimed in claim 10, wherein said transparent substrate is a glass substrate.

12. The method of manufacturing double-sided light-emitting field emission device as claimed in claim 10, wherein said field emission source is carbon nanotube, carbon nanofiber, graphite film, silicon carbide, diamond film, silicon oxide, or metal oxide.

13. The method of manufacturing double-sided light-emitting field emission device as claimed in claim 12, wherein said metal oxide is $Fe_2O_3$, ZnO, $MoO_3$, $SnO_2$, $WO_3$, or $TiO_2$.

14. The method of manufacturing double-sided light-emitting field emission device as claimed in claim 10, wherein said phosphor is a phosphor powder that emits red, green, blue, or white lights.

15. The method of manufacturing double-sided light-emitting field emission device as claimed in claim 10, wherein said additive is Sn, Ni, Cu, Al, glass powder, or $SiO_2$.

16. The method of manufacturing double-sided light-emitting field emission device as claimed in claim 10, wherein percentages by weight (wt %) of compositions of mixed field emission layer material are as follows: field emission source 0.1~10 wt %, phosphor 50~90 wt %, and additive 0~40 wt %.

17. The method of manufacturing double-sided light-emitting field emission device as claimed in claim 16, wherein ratios of said organic vehicle and said mixed field emission layer material are 50~70 wt % said organic vehicle, and 30~50 wt % said mixed field emission layer material respectively.

18. The method of manufacturing double-sided light-emitting field emission device as claimed in claim 10, wherein said paste is formed on said transparent substrate by means of screen printing or thin film lithographic process.

19. The method of manufacturing double-sided light-emitting field emission device as claimed in claim 10, wherein said organic vehicle is terpineol or ethyl cellulose.

* * * * *